US005431452A

United States Patent [19]

Chang et al.

[11] Patent Number: 5,431,452

[45] Date of Patent: Jul. 11, 1995

[54] HIDDEN ENTRY SYSTEM AND IMAGE-DEVELOPING DEVICE THEREFOR

[75] Inventors: John C. H. Chang, Naperville; Donald Hoffmann, Elmhurst, both of Ill.

[73] Assignee: Wallace Computer Services, Inc., Hillside, Ill.

[21] Appl. No.: 110,253

[22] Filed: Aug. 23, 1993

[51] Int. Cl.[6] ..... B42D 15/00

[52] U.S. Cl. ..... 283/95; 283/901; 283/903

[58] Field of Search ..... 283/117, 901, 95, 96, 283/903, 101; 503/226

[56] References Cited

U.S. PATENT DOCUMENTS

| | | | |
|---|---|---|---|
| 2,929,736 | 3/1960 | Miller et al. | 117/36 |
| 3,004,896 | 10/1961 | Heller et al. | 167/90 |
| 3,189,615 | 6/1965 | Heller et al. | 260/308 |
| 3,249,458 | 5/1966 | Cornell et al. | 117/36.9 |
| 3,349,408 | 10/1967 | Gillen et al. | 346/112 |
| 3,363,336 | 1/1968 | Skinner | 35/36 |
| 3,363,338 | 1/1968 | Skinner et al. | 35/36 |
| 3,383,121 | 5/1968 | Singer | 282/28 |
| 3,451,143 | 6/1969 | Thomas et al. | 35/9 |
| 3,554,781 | 1/1971 | Matsukawa | 117/36.8 |
| 3,682,673 | 8/1972 | Manske | 117/1.7 |
| 3,691,140 | 9/1972 | Silver | 260/78.5 |
| 3,713,861 | 1/1973 | Sharp | 117/15 |
| 3,725,104 | 4/1973 | Fraik | 117/1.7 |
| 3,788,863 | 1/1974 | Scheuer | 106/21 |
| 3,821,010 | 6/1974 | Vincent et al. | 117/36.2 |
| 3,823,022 | 7/1974 | Thomas | 117/1.7 |
| 3,829,133 | 8/1974 | Smagala-Romanoff | 283/6 |
| 3,857,731 | 12/1974 | Merrill, Jr. et al. | 117/122 |
| 3,920,863 | 11/1975 | Fraik | 427/145 |
| 3,954,803 | 5/1976 | Vincent et al. | 260/335 |
| 3,957,495 | 5/1976 | Teranishi et al. | 106/19 |
| 4,010,292 | 3/1977 | Shackle et al. | 427/150 |
| 4,012,419 | 3/1977 | Vincent et al. | 260/335 |
| 4,037,007 | 7/1977 | Wood | 428/199 |
| 4,051,283 | 9/1977 | Thomas et al. | 428/29 |
| 4,104,437 | 8/1978 | Vincent et al. | 428/307 |
| 4,109,047 | 8/1978 | Fredrickson | 428/307 |
| 4,111,702 | 9/1978 | Fraik | 106/19 |
| 4,112,138 | 9/1978 | Davis et al. | 427/54 |
| 4,137,343 | 1/1979 | Davis et al. | 427/150 |
| 4,139,218 | 2/1979 | Davis et al. | 282/27.5 |
| 4,139,392 | 2/1979 | Davis et al. | 106/14.5 |
| 4,140,733 | 2/1979 | Meyer, Jr. et al. | 260/897 B |
| 4,143,890 | 3/1979 | Davis et al. | 282/27.5 |
| 4,162,165 | 7/1979 | Schwab | 106/21 |
| 4,170,483 | 10/1979 | Shackle et al. | 106/21 |
| 4,171,981 | 10/1979 | Austin et al. | 106/14.5 |
| 4,174,857 | 11/1979 | Koza | 283/901 X |

(List continued on next page.)

FOREIGN PATENT DOCUMENTS

| | | | |
|---|---|---|---|
| 2722427 | 5/1977 | Germany . | |
| 2913321 | 4/1979 | Germany . | |
| 3211102 | 10/1983 | Germany | 283/95 |
| 62-227794 | 10/1987 | Japan . | |
| 2122995 | 5/1990 | Japan . | |
| 1520919 | 12/1975 | United Kingdom . | |
| 2060491 | 5/1981 | United Kingdom | 283/96 |
| 2188283 | 9/1987 | United Kingdom . | |
| 9100390 | 1/1991 | WIPO . | |

OTHER PUBLICATIONS

Research Disclosure (No. 187), Nov. 1979, pp. 638–639.

*Primary Examiner*—Willmon Fridie

*Attorney, Agent, or Firm*—Roylance, Abrams, Berdo & Goodman

[57] ABSTRACT

A hidden entry system comprises a document having a first substrate bearing a localized latent image spaced apart from a removable image-developing device comprising a second substrate having a first surface and a second surface, the first surface of the second substrate bearing a chromogenic composition comprising an image-forming co-reactant, the image-forming co-reactant being a chromogen or a color developer, the second surface of the second substrate bearing a pressure-sensitive adhesive. The image developing device is in superposed relation with the first substrate with the pressure sensitive coating being releasably attached to the first substrate.

24 Claims, 3 Drawing Sheets

U.S. PATENT DOCUMENTS

| | | | |
|---|---|---|---|
| 4,175,774 | 11/1979 | Tonges et al. | 283/6 |
| 4,183,989 | 1/1980 | Tooth | 428/195 |
| 4,186,020 | 1/1980 | Wachtel | 106/22 |
| 4,197,346 | 4/1980 | Stevens | 428/307 |
| 4,199,618 | 4/1980 | Golden | 427/145 |
| 4,210,346 | 7/1980 | Mowry, Jr. et al. | 283/8 B |
| 4,264,365 | 4/1981 | Sanders | 106/21 |
| 4,278,589 | 7/1981 | Dexter et al. | 260/45.8 |
| 4,303,307 | 12/1981 | Tureck et al. | 350/276 R |
| 4,317,743 | 3/1982 | Chang | 252/316 |
| 4,336,067 | 6/1982 | Shackle et al. | 106/21 |
| 4,360,548 | 11/1982 | Skees et al. | 428/29 |
| 4,376,887 | 3/1983 | Greenaway et al. | 235/487 |
| 4,425,386 | 1/1984 | Chang | 427/256 |
| 4,448,445 | 5/1984 | Chang et al. | 346/206 |
| 4,488,646 | 12/1984 | McCorkle | 206/459 |
| 4,505,498 | 3/1985 | Weinberger | 283/91 |
| 4,631,203 | 12/1986 | Schaefer et al. | 427/145 |
| 4,726,608 | 2/1988 | Walton | 283/96 |
| 4,747,619 | 5/1988 | Sager | 282/9 R |
| 4,784,876 | 11/1988 | Walker, Jr. et al. | 427/150 |
| 4,839,396 | 6/1989 | Tusim | 521/88 |
| 4,846,502 | 7/1989 | Chang et al. | 283/57 |
| 4,873,219 | 10/1989 | Brown et al. | 503/204 |
| 4,918,045 | 4/1990 | Matsuoka et al. | 503/213 |
| 4,940,690 | 7/1990 | Skees | 503/206 |
| 5,132,034 | 7/1992 | Hsu et al. | 252/47.5 |
| 5,193,854 | 3/1993 | Borowski, Jr. et al. | 283/87 |
| 5,212,219 | 5/1993 | Griffin | 524/17 |
| 5,250,492 | 10/1993 | Dotson et al. | 503/201 |

HIDDEN ENTRY SYSTEM AND IMAGE-DEVELOPING DEVICE THEREFOR

CROSS-REFERENCE TO RELATED APPLICATIONS

Reference is hereby made to U.S. applications Ser. No. 07/987,710 entitled "Heat Sensitive System and Use Thereof" to John C. H. Chang filed Dec. 9, 1992, Ser. No. 07/987,694 entitled "Hidden Entry System and Use Thereof" to John C. H. Chang and Peter A. Walter filed Dec. 9, 1992, copending U.S. application Ser. No. 08/075,419 entitled "Pressure and Heat-Sensitive System and Use Thereof" to John C.H. Chang and Richard H. Johnson filed Jun. 14, 1993, and copending U.S. application Ser. No. 08/075,420 entitled "Pressure-Sensitive Verification System and Use Thereof" to John C. H. Chang filed Jun. 14, 1993, the disclosures of which are hereby incorporated by reference.

FIELD OF THE INVENTION

The present invention is directed to a hidden entry system for maintaining information hidden until utilized and a device used to reveal the hidden entry. More particularly, this invention relates to documents having a localized latent image which is developed to form a visible image using a device which can be easily packaged with such document.

BACKGROUND OF THE INVENTION

Various methods have been proposed for preparation of sweepstakes contest awards, lottery tickets, promotional game cards, premium cards, and the like, containing hidden entries, such as numerals, messages, symbols, or the like, which can be revealed to the recipient by various means.

For example, U.S. Pat. No. 4,726,608 to Walton discloses use of an opaque coating over hidden indicia. The image of the indicia is later made visible by scratching off the opaque coating or by applying a solvent to disperse the coating. This system has the disadvantage of requiring extraneous solvents.

Copending U.S. application Ser. No. 07/987,694 entitled "Hidden Entry System and Use Thereof" to John C. H. Chang and Peter A. Walter filed Dec. 9, 1992 discloses a heat sensitive, autogenous chromogenic hidden system on sweepstakes documents or the like, and requires application of heat to develop the latent image, such as by use of friction resulting by scratching the latent image with the human fingernail. Since the latent image is heat sensitive, it can prematurely develop when the document is utilized with a laser printer to provide addressee information or the like on the sweepstakes document.

SUMMARY OF THE INVENTION

A hidden entry system including a device for developing the latent image has now been discovered which can be used to provide and develop hidden indicia on a document used, for example, in a contest or promotion, such as sweepstakes contest awards, lottery tickets, premium cards, promotional game cards, or the like, to hide indicia without premature development of the hidden indicia by heat from a laser printer or from manufacturing, handling or storage.

The hidden entry system of the present invention comprises a first substrate bearing a localized latent image, which is formed of an image-forming reactant, and an image-developing device for developing the latent image comprising a second substrate having a first surface and a second surface, the first surface of the second substrate bearing a chromogenic composition comprising an image-developing co-reactant, the second surface of the second substrate bearing a pressure-sensitive adhesive.

The image-developing device is superposed on and releasably attached to the first substrate while being spaced apart from the localized latent image. The expression "releasably attached" as used in this application includes direct contact between the pressure-sensitive adhesive and the first substrate, and indirect attachment of the pressure-sensitive adhesive to the first substrate by means of a release liner which is permanently secured to the first substrate or a release substance or film coated on the first substrate.

The image-forming reactant may be a chromogen or a color developer. The image-developing co-reactant may also be a chromogen or a color developer. A chromogen and a color developer react together to form colored images. Thus, when a chromogen is used as the image-forming reactant, a color developer should be used as the image-developing co-reactant. Similarly, when a color developer is used as the reactant, a chromogen should be used as the image-developing co-reactant. Thus, as used in the present application, the term "reactant" is used to denote material forming the latent image, while the term "co-reactant" is used to denote the material on the image-developing device which reacts with the reactant to convert the latent image to a visible image. However, as indicated, a chromogen or color developer may be used interchangeably, for reaction with one another to form the visible image.

According to a preferred embodiment of the present invention, the image-developing device for developing the latent image in a hidden entry system comprises a substrate having a first surface and a second surface, the first surface of the substrate bearing a chromogenic composition, the chromogenic composition comprises a mixture of a wax and an image-developing co-reactant, the image-developing co-reactant being a chromogen or a color developer, the second surface of the substrate bearing a pressure-sensitive adhesive. The substrate is configured such that the device may be gripped by the pressure-sensitive adhesive to rub the latent image with the image-developing co-reactant, the latent image being formed from a reactant capable of forming a visible image upon contact with the image-developing co-reactant chromogenic composition.

The pressure-sensitive adhesive of the image-developing device of the present invention is "dual-functional", since it serves to removably adhere the image-developing device to the release coating on the document, such as the sweepstakes award, and also serves to adhere the image-developing device to the human finger to enable one to grip the image-developing device while rubbing it across the latent image to form a visible image.

Since the image-developing device containing the co-reactant and latent image formed of the reactant are not juxtaposed until use to develop a visible image, for example, on a sweepstakes award, premature development of the hidden indicia during manufacturing, handling and storage is avoided.

According to another embodiment of the present invention, chromogenic composition of the image-developing device comprises a polar wax as the vehicle for the chromogenic composition thereby providing improved image-development. Surprisingly, it has been discovered that polar waxes can be used as a vehicle for color developers in the present hidden entry system, while the Lewis base polyethylene glycol (Carbowax), which has been used in prior hidden entry systems, desensitizes color developers of the present invention.

According to still another embodiment of the present invention, the chromogenic composition of the image-developing device comprises a metallic powder which assists in breaking the coating barrier between the color developer and chromogen to promote color development.

According to still another embodiment of the present invention, the image-developing device is formed in a desired shape or configuration, such as a coin, tool, toy, book, disc, logo, regular geometric shape, or the like for the purpose of improving the commercial attractiveness of the system or for improving the ability to grip the image-developing device when rubbing it across the latent image to form a visible image. For example, by adding a gold metallic powder to the chromogenic composition, an image-developing device in the form of a gold coin can be provided.

According to still another embodiment of the present invention, a device for developing the latent image in a hidden entry system is provided, which comprises a substrate having a first surface and a second surface, the first surface of the substrate bearing a chromogenic composition comprising an image-developing co-reactant, the image-developing co-reactant being a chromogen or a color developer, the second surface of the substrate bearing a pressure-sensitive adhesive, the substrate being configured such that the device may be gripped by the pressure-sensitive adhesive to rub the chromogenic composition across a latent image formed from a reactant capable of forming a visible image upon contact with the image-developing co-reactant.

According to another embodiment of the present invention, the image-developing device has a very slight thickness, such what when it is applied to the document, such as sweepstakes letter, it adds little thickness to the document and enables the document to be processed by computer printers as a multi-ply business form.

According to a still further embodiment of the present invention, a method for developing a hidden entry is provided which comprises providing a hidden entry system comprising a first substrate having a first surface bearing a localized latent image formed of an image-forming reactant, which is either a chromogen or a color developer, on a first portion of the first surface and a localized release coating on a second portion of the first surface of the first substrate, the hidden entry system additionally comprising a device which comprises a second substrate having a first surface and a second surface, the first surface of the second substrate bearing a chromogenic composition, the chromogenic composition comprising a mixture of a wax and an image-developing co-reactant, the image-developing co-reactant being a chromogen or a color developer capable of reacting with the image-forming reactant, the second surface of the second substrate bearing a pressure-sensitive adhesive, the image-developing device being in superposed relation to said first substrate such that the release coating is in contact with the pressure sensitive coating of the second substrate, separating the device from the first substrate of the second surface. The image-developing device is separated from the first substrate to manually contact the chromogenic composition portion of the device with the localized latent image to form a visible image from the latent image, the pressure-sensitive adhesive providing an anchor for the manually contacting.

The expression "gripped" as used in the present application is in the sense that one can manually grasp the image-developing device with one or more fingers, as well as by placing one or more fingers on the pressure-sensitive adhesive portion of image-developing device and by applying radial pressure to the image-developing device, move it transversely across the latent image coating of the document with the chromogenic composition in contact with the latent image such that a visible image is formed. Thus, the expression "gripped" as used in this application includes placing a single human finger on the pressure-sensitive portion of the image-developing device to adhesively engage the device and apply pressure to the device while moving it in a transverse direction to frictionally engage the latent image with the chromogenic composition portion of the image-developing device.

As used in the present application, the term "indicia" is used to include any number, letter or symbol in a general sense.

Other advantages and salient features of the present invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE INVENTION

Figure 1:
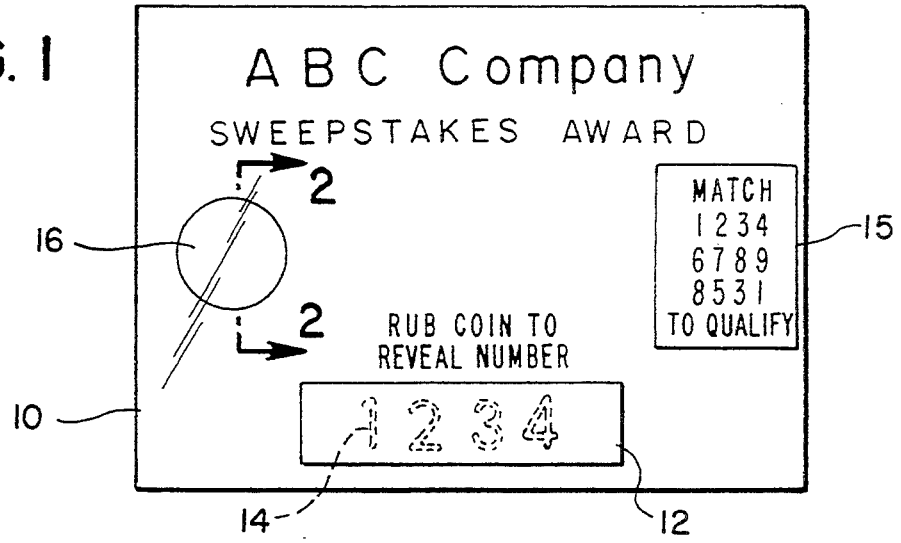
FIG. 1 is a front elevational view of a sweepstakes document showing the image-developing device attached adjacent the hidden entry area on the front face of the document.

Referring to the drawings, FIG. 1 illustrates a hidden entry system in combination with document 10.

The term "document" as used herein is intended to include any type of document or paper used to hide indicia until it is desired to reveal such indicia, including lottery tickets, sweepstakes, raffles, prizes and awards.

In the embodiment illustrated in FIG. 1, document 10 is a sweepstakes award having an information area 12. A chromogenic compound or color developer is formed into a colorless ink and printed to form, as combination 14, numerals "1234", as latent image-forming indicia on information area 12. Of course, any indicia, including alphanumeric indicia, symbols or design indicia may be imprinted in lieu of the numerals 14. Although color developer may be printed to form the latent image, it is generally preferred to produce the latent image from the chromogenic compound.

The chromogenic compound in preferred embodiments is colorless before reacting with the color developer to produce the colored image. Suitable chromogenic compounds include diarylmethanes, triarylmethanes, indolylphthalides, azaphthalides, fluorans, and spiropyrans. Exemplary diarylmethanes include 4,4'-bis(dimethylaminobenzhydrylbenzyl)ether, N-halophenyl leuco auramine, and N-2,4,5-trichlorophenyl leuco auramine. Examples of triarylmethanes include 3,3-bis(p-dimethylaminophenyl)-6-dimethylaminophthalide and 3,3-bis(p-dimethylaminophenyl)phthalide. Examples of indolylphthalides include 3-(p-dimethylaminophenyl)-3-(1,2-dimethylindole-3-yl)phthalide and 3-(p-dimethylaminophenyl)-3-(2-methylindole-3-yl)phthalide. Examples of azaphthalides include 3-(2-ethoxy-4-diethylaminophenyl)-3-( 1-octyl-2-methylindole-3-yl)-4-azaphthalide and 3-(2-ethoxy-4-diethylaminophenyl)-3-(1-ethyl-2-methylindole-3-yl)-4-azaphthalide. Examples of fluorans include 2-dibenzylamino-6-diethylaminofluoran, 2-anilino-6-diethylaminofluoran, 3-methyl-2-anilino-6-diethylaminofluoran, 2-anilino-3-methyl-6-(ethyl-isopentylamino)fluoran, 2-anilino-3-methyl-6-dibutylaminofluoran, 2-chloro-3-methyl-6-diethylaminofluoran, 3,6-dimethoxyfluoran, and 7,7'-bis(3-diethylaminofluoran). Examples of spiropyrans include 3-methylspirodinaphthopyran, 3-ethylspirodinaphthopyran, 3,3'-dichlorospirodinaphthopyran, 3-benzylspirodinaphthopyran, and 3-methylnaphtho-(3-methoxybenzo)spiropyran. Other suitable chromogenic compounds are disclosed in U.S. Pat. Nos. 3,821,010; 3,954,803; and 4,104,437 to Vincent and Chang, the disclosures of which are hereby incorporated by reference.

The chromogen utilized to form the latent image may be dissolved in a solvent, such as benzyl xylenes, diaryl alkanes, monobutylbiphenyls, monoisopropylbiphenyls, dibutylbiphenyls, di-isopropylbiphenyls, monoisopropylnaphthalenes, di-isopropylnaphthalenes, and hydrogenated terphenyls along with wax and oil for use in the image-developing device, or the chromogen solution may be printed on the document to form the latent image. Likewise, the chromogen solution may be microencapsulated for incorporation into the wax or printed on the document to form the latent image.

Pressure-rupturable microcapsules useful in the present invention may be formed in any suitable manner conventionally employed. For example, capsules formed from coacervation of gelatin, polycondensation of urea-formaldehyde, interfacial cross-linking, or hydrolysis of isoclyanatoamidine products may be used. Preferably, the microcapsules are formed by a microencapsulation process described in U.S. Pat. No. 4,317,743 to Chang, the disclosure of which is hereby incorporated by reference.

Attached to document 10 is latent image-developing device 16 configured in the form of a coin. Alternatively, device 16 may be formed in other shapes, such as an automobile, boat or company logo, for example. FIG. 2 is an enlarged, sectional view of the construction of image-developing device or coin 16 as attached to document 10. The laminate construction 20 includes a top layer of chromogenic composition 22 comprising a color developer or chromogenic compound co-reactant for the reactant forming latent image indicia 14. Although a chromogen or color developer may be utilized in chromogenic composition 22, preferably, chromogenic composition 22 utilizes a color developer.

Suitable color developers are electron acceptor materials, such as Lewis acids. Preferred electron-acceptor materials for inclusion in chromogenic composition 22 are the Lewis acids conventionally used to prepare carbonless copy papers. Preferred Lewis acids include, for example, zincated alkylphenol-formaldehyde novolac resins, zinc salts of alkylsalicylic acids, polymeric zinc salycilates, and the like.

Preferably, the color developer of chromogenic composition 22 is dispersed in a wax, which is preferably a polar wax. Suitable polar waxes are those natural and synthetic waxes characterized by the presence of functional groups selected from the group consisting of carboxyl, carbonyl, hydroxyl, ester, amide, amine, heterocyclic groups and combinations thereof. Examples of polar waxes include carnauba wax, rosin, modified rosins, fatty acids, fatty acid derivatives, oxazoline waxes, montan wax, montan wax derivatives, and the like.

Polar waxes are disclosed, for example, in U.S. Pat. Nos. 4,139,218 and 4,336,067, the disclosures of which are hereby incorporated by reference.

Chromogenic composition 22 may also include a metallic powder which assists in breaking the coating barrier to promote color development between the chromogen and color developer, and may provide color and texture to coin 16.

Any metallic powder can be used in the wax portion of the image-developing device of the present invention, including the finely divided colored pigments conventionally used in surface coatings, which provide color and preferably a rough or coarse surface characteristic to the surface of the image-developing device contacting the latent image. Suitable pigments include red pigments, such as the iron oxides, e.g., Indian red, Spanish red; gold powder, such as that formed from a gold/bronze alloy; orange pigment, such as Chrome orange (basic lead chromate); brown pigment, derived from iron oxides; green pigment, such a chrome green (a mixture of chrome yellow and Prussian blue), chromium oxide; blue pigment, such as Prussian blue (ferric ferrocyanide), ultramarine (fused soda and sulfur), purple pigment, such as manganese phosphate; black pigment, such as carbon black and black iron oxide. A combination of one of the foregoing pigments and a coarse material, such as pumice in powder form, or pumice powder alone, may be added to the chromogenic composition forming the outer surface of the image-developing device. Suitable amounts of the pigment include from about 1 to about 20 weight percent, preferably from about 3 to about 10 weight percent based on the chromogenic composition containing wax.

Chromogenic composition 22 is supported by paper or paper-like sheet 24 which is secured by pressure-sensitive adhesive 26 to release liner 28, which, in turn, is secured by permanent laminating or non-pressure sensitive adhesive 30 to document 10. Suitable permanent laminating adhesives include, for example, water-based emulsions, such as ethylene-vinyl acetate co-polymer and styrene-butadiene latex. Examples are Nacor 33-6079 commercially available from National Starch and Chemical Company and Adhesive 3993-C commercially available from H. B. Fuller Company. Likewise, hot-melt adhesives, such as ethylene-vinyl acetate co-polymer adhesives may be employed as permanent laminating adhesive 30, for example, Nacor 34-2925 commercially available from National Starch and Chemical Company. Polyurethane may also be used, such as Nacor 70-9860, commercially available from National Starch and Chemical Company.

Figure 2A:
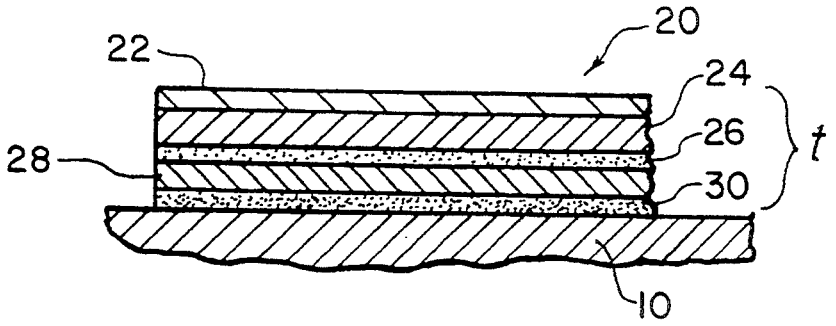
FIG. 2A is an enlarged, diagrammatic cross-sectional view taken on line 2—2 of FIG. 1 showing attachment of the image-developing device to the sweepstakes document.

Laminate construction 20 shown in FIG. 2A comprises a plurality of layers in superposed relation and may be produced in any suitable manner. For example, a color developer may be dissolved in a molten polar wax or a blend of polar waxes. Metallic powder, such as a gold powder, may be mixed into the wax as well. The hot wax liquid composition is then coated to form a layer 22 on the upper surface of a paper or paper-like substrate 24 having pressure sensitive adhesive 26 and release liner 28 previously affixed to the opposite side of substrate 24. Suitable pressure-sensitive adhesives include, for example, water-based emulsions, such as synthetic acrylic polymer emulsions in water, including Nacor 4551 commercially available from National Starch and Chemical Company, Flexcryl 1685 commercially available from Air Products and Chemicals Inc., and 3-40518-01F commercially available from Swift Adhesives Division of Reichold Chemicals, Inc. Likewise, hot melt adhesives may be employed as pressure-sensitive adhesive 26. For example, such adhesives may be compounded mixtures of an elastomer such as styrene-isoprene triblock co-polymer, a tackifier such as rosin esters or terpenes, and a plasticizer such as low molecular weight phthalate, benzoate esters, and petroleum hydrocarbon oils. Examples are Durotak 4144 commercially available from National Starch and Chemical Company and Swift 84441 commercially available from Swift Adhesives Division of Reichold Chemicals, Inc.

Release liner 28 may be any suitable form of release liner. For example, release liner 28 may be a paper substrate having a non-sticking surface on one side formed of silicone-containing polymers, petroleum-based waxes, carbamates of polyvinyl alcohol, or polyvinyl ethers of alkyl alcohol.

The surface of release liner 28 opposite that in contact with pressure sensitive adhesive 26 is then coated with a permanent laminating or non-pressure sensitive adhesive 30, and the resulting assembly is affixed to document 10 to provide the assembly 20 shown in FIG. 2A.

Alternatively, laminate construction 20 in FIG. 2A may be formed by coating the hot wax liquid onto substrate 24, then coating the reverse side of substrate 24 with pressure-sensitive adhesive 26 and thereafter laminated with release liner 28. The assembly is die-cut and affixed onto the document 10 with permanent adhesive 30.

According to another embodiment of the present invention, laminate construction 20 of FIG. 2A may be formed by coating the hot melt chromogenic composition onto the top surface of substrate 24. A pressure-sensitive adhesive is coated over the release coating of a release liner stock. The opposite side of substrate 24 is then laminated with the pressure-sensitive adhesive coated release liner stock to form an assembly. The resulting assembly is die-cut into the desired size and shape, such as a coin, tool, toy, disc, logo, or the like. The shaped assembly is fastened to the document at a designated area with permanent laminate adhesive to provide the image-developing device 16.

Figure 2B:
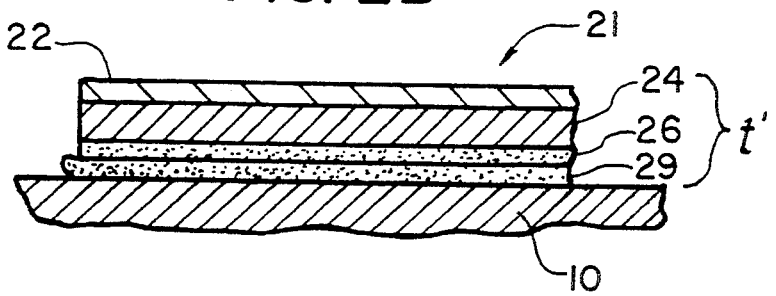
FIGS. 2B and 2C are modified versions of laminate constructions of FIG. 2A.

As shown in FIG. 2B, release liner 28 may be eliminated and the wax and pressure-sensitive adhesive coated substrate 24 may be directly laminated onto release surface 29 provided on document 10. Release surface 29 may be formed directly on document 10 by a printing of silicone oil, a coating of a UV-curable silicone-containing polymer, a coating of hard petroleum-based wax, a coating of silicone-containing polymer, carbamates of polyvinyl alcohol, polyvinyl ethers of alkyl alcohol, a printing of silicone wax or may be formed by a patch of plastic film adhered to document 10.

Figure 2C:
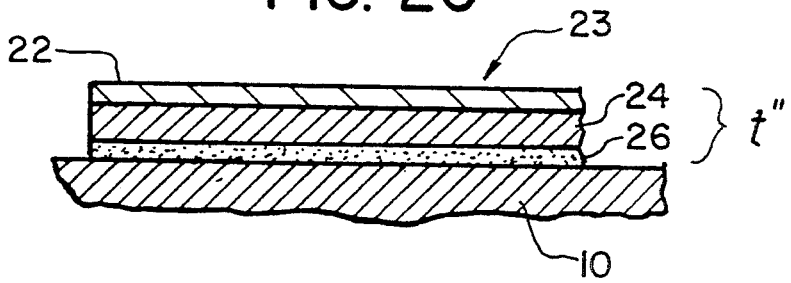
Figure 3:
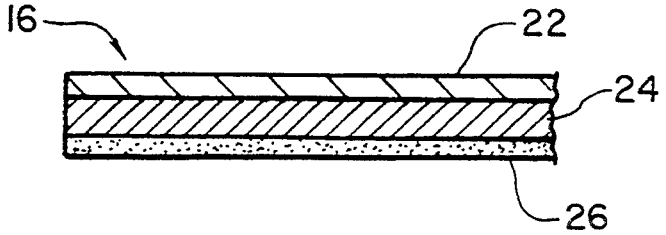
FIG. 3 is a cross-sectional view of the image-developing device of FIGS. 2A, 2B and 2C.

As shown in FIG. 2C, the release surface 29 may be eliminated by using as adhesive 26 a pressure-sensitive adhesive that will easily release from the surface of document 10, but will adhere sufficiently to human skin to enable use of laminate construction 16 of FIG. 3 to rub and convert the latent image 14 into a visible image. A suitable pressure sensitive adhesive having such characteristics is, for example, a pressure-sensitive adhesive including acrylate copolymer microspheres, such as the adhesives disclosed in U.S. Pat. No. 3,691,140 to Silver and U.S. Pat. No. 3,857,731 to Merrill et al., the disclosures of which are hereby incorporated by reference. Also useful is the removable or repositional water-based, pressure-sensitive adhesive known as Stik-Withit SW 101 J, commercially available from Paper Conversions, Inc. of Syracuse, N.Y., which has the properties of low tack and clean removability. Other useful adhesives having such characteristics are Aroset 2551-W-52, Aroset 2532-W-50, and Aroset 2556-W-54 commercially available from Ashland Chemical, Inc. and Nacor 4536 from National Starch and Chemical Company.

As shown in FIG. 1, the image-developing device 16 is in the shape of a coin, and since gold powder has been mixed into the polar wax composition, the congealed wax layer 22 will provide device 16 with the appearance of a gold coin.

Alternatively, layer 22 may comprise microencapsulated chromogen dispersed in the wax medium, while hidden entries 14 of FIG. 1 are printed with an ink-based color developer of the type previously described.

Likewise, the hidden entries may be printed with the chromogenic compound dissolved in an organic vehicle, such as dibutylbiphenyl, while layer 22 is formed by dissolving the color developer in a solution of polar wax in oil normally used in the microcapsules. Optionally, the chromogen and color developer may be interchanged.

According to another embodiment of the present invention, the wax may be eliminated from layer 22 by coating the upper surface of substrate 24 with water-based microcapsules containing chromogen, and the lower surface of substrate 24 with pressure-sensitive adhesive 26 as shown in FIG. 3. Since the microcapsular coating on substrate 24 is colorless, printing in the form of instructions, a special message, logo, symbol, solid color, metallic printing or the like, may be printed on substrate 24 either under the microcapsular coating or over it.

The microcapsules may be of any suitable size, for example, and have an average diameter of between about 1 to about 20 microns, preferably, between about 3 to about 7 microns to avoid premature rupture. Likewise, a load bearing agent such as starch may be added to the coating to help prevent premature rupture of the microcapsules.

Pressure-sensitive adhesive 26 in combination with release liner 28, or release coating 29, or use of an easy release pressure-sensitive adhesive as in FIG. 2C, permits easy separation of coated sheet 24 from document 10 to provide image-developing device or coin 16 as shown in FIG. 3, which comprises chromogenic composition layer 22, sheet 24 and pressure-sensitive adhesive layer 26.

Pressure-sensitive adhesive 26 is "dual-functional" in that it not only secures image-developing device or coin 16 to the release liner adhered to document 10, as shown in FIG. 2A, but is used to secure coin 16 to the user's finger when using coin 16 to develop the latent or hidden image 14 of FIG. 1.

Figure 4:
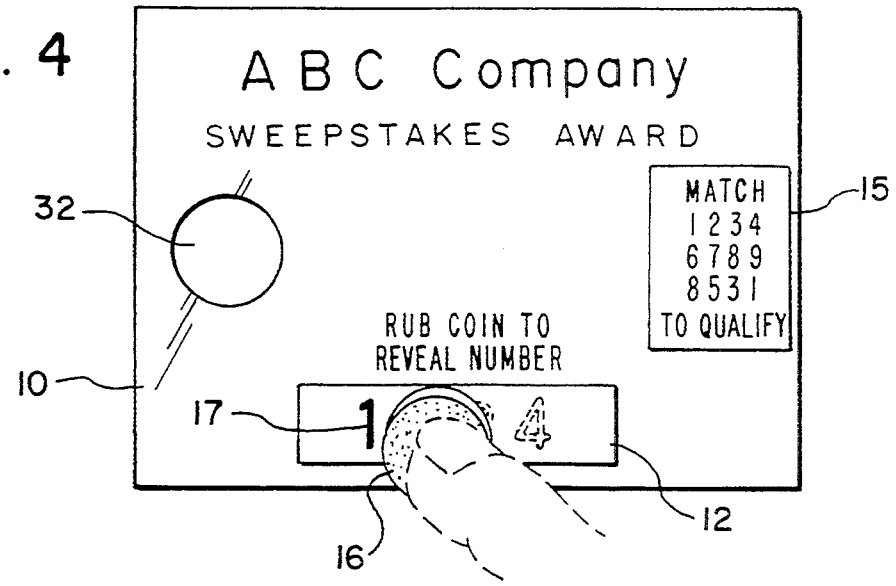
FIG. 4 is a schematic view of the sweepstakes document of FIG. 1 using the image-developing device to develop a portion of the hidden entry area.
Figure 5:
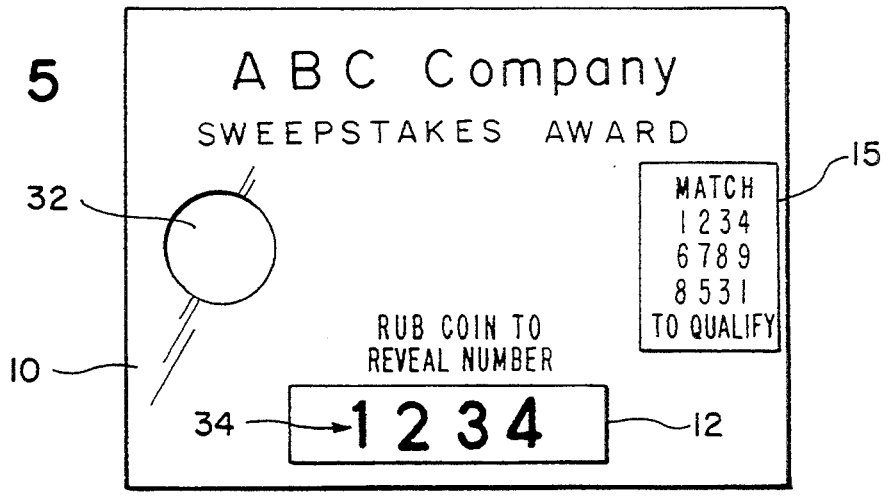
FIG. 5 is a front elevational view of the sweepstakes document of FIG. 4 having the previously hidden image completely displayed to reveal the participant's number.

Referring to FIG. 4, coin 16 has been peeled apart from document 10 leaving behind release liner or release material 32 on document 10, and coin 16 is placed on a fingertip such that the pressure-sensitive adhesive secures or anchors coin 16 firmly to the user's fingertip. Using repetitive strokes in a reciprocating or oscillating motion while pressing and rubbing chromogenic composition 22 of coin 16 across latent image numbers 14 causes color developer in the chromogenic composition of coin 16 to contact the chromogenic compound comprising latent image numbers 14, and results in reaction between the color developer and chromogen to convert latent image 14, such as numeral 1, to visible colored image 17 until all such numerals, 1, 2, 3 and 4 are converted to visible colored numerals 34 as shown in FIG. 5. The aware recipient then compares the visible numerals in information area 12 with those in area 15 to see if there is a match. If so, the recipient qualifies to continue in the sweepstakes contest.

In the embodiment of FIG. 1, information area 12 is positioned in the lower center of the front face of the sweepstakes document with image-developing device 16 spaced apart from information area 12. It is to be understood that information area 12 comprising hidden images 14 and image-developing device 16 may be located in any position or area on the document, and that multiple localized coatings of latent images formed of such chromogenic compositions may be present on the front of the document and on both the front and back of the document, as desired.

The amount of chromogen used in the hidden entry system of the present invention is generally the amount needed to react with the color developer or Lewis acid, and may be present in amount of, for example, from about 1 part by weight to about 30 parts by weight chromogen, preferably, from about 5 parts by weight to about 20 parts by weight chromogen per 100 parts by weight Lewis acid.

A suitable binder material is needed to adhere the chromogen-containing pressure-rupturable microcapsules onto the surface of document 10 or substrate 24 when wax is omitted from layer 22. The amount of binder generally used is about 10% to about 50% by weight, and preferably about 15% to about 35% by weight, based on the total weight of the solids of the coating composition. Examples of useful binders include starch, hydroxyethyl cellulose, methyl cellulose, carboxymethyl cellulose, gelatin, casein, gum arabic, polyvinyl alcohol, styrene-maleic anhydride copolymers, ethylene-acrylic acid copolymers, styrene-butadiene copolymers, acrylonitrilebutadiene copolymers, vinyl acetate emulsions, ethylenevinyl acetate emulsions.

The microcapsular coating composition of the present invention may optionally additionally contain a color suppressant to prevent premature coloration. The color suppressant must be so chosen that it will not inhibit or adversely affect the color formation in the final product. Examples are ammonium hydroxide, alkanolamines, such as monoethanol amine, diethanolamine, N, N-dimethylethanolamine, and the like, condensates of amineformaldehyde, such as urea-formaldehyde, melamineformaldehyde, and the like. Suitable amounts of such color suppressants include from about 0.1 to about 10, preferably from about 0.5 to about 4 percent by weight based on the total dry weight of the coating composition. Other suitable color suppressants are disclosed, for example, in U.S. Pat. Nos. 4,010,292 and 4,170,483, which are hereby incorporated by reference.

The microcapsular coating composition may be applied to the substrate, for example, paper, plastic, or the like, which forms the document by any suitable technique as known in the art to provide a localized, spot or band coating. In a preferred embodiment of the invention, the chromogenic coating composition is prepared as a slurry comprising the chromogen-containing pressure-rupturable microcapsules. Any suitable method may be employed for providing the latent image. A preferred method of coating is by off-set gravure coating as disclosed in U.S. Pat. No. B1 4,425,386 to Chang which is hereby incorporated by reference. Alternative preferred coating methods include flexographic, screen printing, nozzle extrusion and ink jet printing.

An ultraviolet light absorbing compound may incorporated into the pressure-rupturable microcapsules along with the chromogenic compound when the pressure-rupturable microcapsules are printed to form a latent image on a document or incorporated in the coating on the image-developing device. Surprisingly, it was found that if prior to use, a document of the present invention, such as a sweepstakes award letter, is left uncovered, for example, near a window in an automobile or near a window in a house, and the latent image area printed with chromogen becomes exposed to natural light, such as from sunlight or other source of ultraviolet light, the chromogenic material becomes inactive and the hidden entry function of the document is destroyed in a day or so. However, it has been found that by incorporating an ultraviolet light absorbing compound in the pressure-rupturable microcapsules along with the chromogenic compound, even after exposure to sunlight, the chromogenic compound can react with the color developer upon rupture of the microcapsules containing the chromogenic compound.

Although an ultraviolet light absorbing compound has been incorporated in microcapsules used in the pressure-sensitive recording paper system disclosed in U.S. Pat. No. 3,554,781, such compound is used for a purpose different from that of the present invention. In particular, such recording paper system is concerned with preserving the visible image after it is formed by reaction of the chromogenic compound and color developer on the record sheet, since such sheets are not normally exposed to outside light, if at all, until after a colored image has been formed. Prior to use, such recording paper is stored in boxes or cabinets and is not exposed to sunlight. In contrast, the latent image area on the documents of the present invention may well be exposed to daylight, since such document might be left by an open window after the sweepstakes award letter is received.

Any suitable ultraviolet light absorbing compound may be encapsulated along with the chromogenic compound of the present invention. Preferred ultraviolet light absorbing compounds for use in the present invention include, for example, the substituted benzotriazoles available from Ciba-Geigy under the tradename "Tinuvin", such as Tinuvin P disclosed in U.S. Pat. Nos. 3,004,896 and 3,189,615, which are hereby incorporated by reference, having the general formula 2-(5'-methyl-2'-hydroxyphenyl)benzotriazole; Tinuvin 326, which has the general formula 2-(5'-methyl-3'-tert-butyl-2'-hydroxylphenyl)-5-chlorobenzotriazole; Tinuvin 327, having the general formula 2-(3',5'-di-tert-butyl-2'-hydroxyphenyl)-5-chlorobenzotriazole; Tinuvin 328, which has the formula 2-(3',5'-di-tert-pentyl-2'-hydroxyphenyl)benzotriazole, and Tinuvin 900, disclosed in U.S. Pat. No. 4,278,589, which is hereby incorporated by reference, which has the formula 2-[2-hydroxy-3,5-di(1,1-dimethylbenzyl)phenyl]-2-H-benzotriazole.

The ultraviolet light absorbing compound is used in any suitable amount, for example, from about 5 to about 150 weight percent, based upon the weight of the chromogenic compound, with a preferred amount being from about 20 to about 80 weight percent, based on the weight of the chromogenic compound.

According to another embodiment of the present invention, it has been found that hindered phenols normally used as antioxidants to hinder thermally-induced oxidation of polymers in coatings for high temperature applications, for example, to prevent yellowing caused by heat, act as stabilizers for the chromogen in the capsules. The hindered phenols can be used in place of the benzotriazole ultraviolet light absorbing compounds. Surprisingly, it has been found that hindered phenols stabilize chromogen in the microcapsules when exposed to sunlight even at ambient temperatures.

Suitable hindered phenols include, but are not limited to, for example, 2,6-di-tert-butyl-p-cresol; 4,4'-methylene bis(2,6-di-tert-butylphenol); 4-methyl-2,6-bis(2'-hydroxy-3'-tert-butyl-5'-methylbenzyl)phenol; the Irganox hindered phenols, such as Irganox 129, Irganox 245, Irganox 1010, Irganox 1076, Irganox 1035 and Irganox MD 1024 commercially available from Ciba-Geigy Corporation. Such hindered phenols have the general structural formula

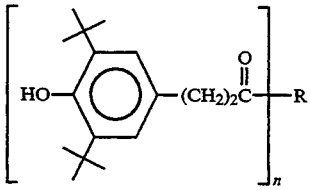

wherein R is an alkoxy, a substituted alkoxy, or —N-H—NH—group and n is an integer from 1 to 4. For example, R is C $(CH_2O—)_4$ when n=4, R is —O—$C_{18}H_{37}$ when n=1, R is —O—$(CH_2)_2$—S—$(CH_2)_2$—O— when n=2, and R is —NH—NH— when n=2.

Irganox 129 is 2,2'-ethylidene-bis(4,6-di-tertbutylphenol); Irganox 245 is ethylene bis(oxyethylene)-bis(3-tert-butyl-4-hydroxy-5-methylhydrocinnamate); Irganox 1010, which is identified as tetrakis[methylene-3-(3',5'-di-tert-butyl-4'-hydroxyphenyl)propionate]-methane; Irganox 1076 is octadecyl 3,5-di-tert-butyl-4-hydroxyhydrocinnamate; Irganox 1035 has the general formula

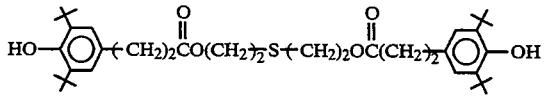

while Irganox MD 1024 has the general formula

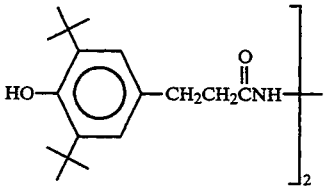

Any hindered phenol useful as an antioxidant is useful as a stabilizer for the chromogen in the capsules of the present invention. The hindered phenol stabilizer is used in any suitable amount, for example, from about 5 to about 150 weight percent, based upon the weight of the chromogenic compound, with a preferred amount being from about 20 to about 80 weight percent based on the weight of the chromogenic compound. Surprisingly, it was found that the hindered phenol can be used in place of a benzotriazole and still provide effective stability for the chromogen in the capsules.

When the present invention is used to provide lottery tickets or sweepstakes awards, for example, the latent image indicia of the hidden entry system of the present invention will normally be a numerical sequence on each ticket or form which varies from form to form depending upon the number of winners in each category, for example.

Figure 6:
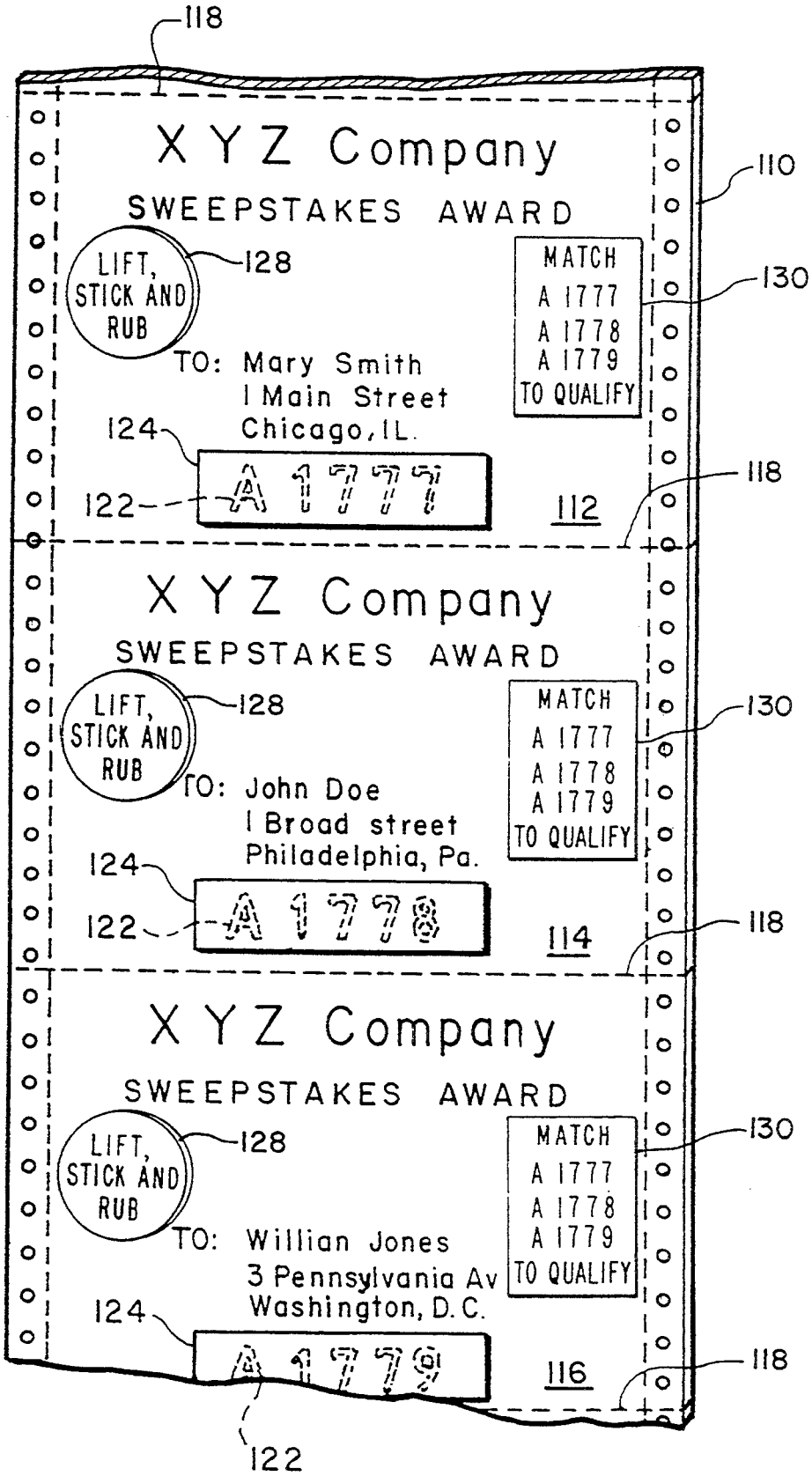
FIG. 6 is a multi-ply sweepstakes form with an image-developing device of the present invention.

Referring now to FIG. 6, form 110 comprises a plurality of sweepstakes award forms 112, 114, 116 separated by perforated lines 118. Each individual form has sequences of predetermined indicia printed thereon with the latent images 122 of indicia on information area 124 formed from a color developer, in which at least a portion of the forms have sequences of latent image numbers which may differ or repeat from form to form or ticket to ticket for comparison to visible numerals in match area 130.

Each form is provided with image-developing device 128 having the laminate structure shown in FIG. 2A for coin 16, except that the chromogenic composition 22 comprises a coating of water-based, chromogen-containing microcapsules and no wax matrix is used. Since the capsular coating is colorless, it reveals instructional printing 127 on the paper substrate of coin 128, which instructs the user to "LIFT, STICK AND RUB" coin 128 over the hidden entry in information area 124. Latent image 122 may be formed from, for example, either a color producing chromogen or a color developer with the co-reactant, respectively, being microencapsulated.

Coins 126 are sufficiently thin, that when attached to forms 112, 114 and 116 they, too, can pass through a computer printer. Thus, structure 20 including image-developing device 16 as shown in FIG. 2A has a cross-sectional thickness, t, of from about 4 to about 20 mils, preferably from about 6 to about 12 mils. Likewise, structure 21 of FIG. 2B has a thickness t' and structure 23 of FIG. 2C has a thickness of t'' within such range. Substrate 10 upon which structure 20 is supported has the thickness of a normal paper substrate. The forms are then separated and mailed or otherwise distributed as desired.

The invention will be further illustrated by the following examples. It should be understood that the examples are not intended to limit the scope of this invention. Percentages are by weight unless otherwise indicated.

EXAMPLE 1

Three hundred grams of capsule slurry were formed containing 4.5 grams of crystal violet lactone and 8.9 grams of polyvinyl alcohol. One hundred twenty grams of Keestar starch particles (commercially available from Ogilvie Mills, Inc.) were added to the slurry and the total solids adjusted to 40% by the addition of 180 grams of water. The resulting slurry was used to print latent images.

A mixture of 90 grams of carnauba wax and 10 grams of alkylphenol-formaldehyde novolac resin HRJ-2346 (from Schenectady Chemicals, Inc.) was heated at about 100° C. until a clear solution was obtained. Ten grams of MDRICH 110P gold bronze powder (from MD-BOTH Industries) were added to the solution and well-dispersed. The hot wax liquid was coated on a paper substrate which has a pressure-sensitive adhesive and release liner on its opposite side. The assembly was die-cut into the shape of a coin and glued onto a document by applying a permanent adhesive on the back side of the release liner.

The color developer-coated coin-shaped substrate was peeled off the release liner. It firmly adhered onto the finger and was rubbed over the latent images. A visible blue colored image appeared instantly.

EXAMPLE 2

A group of numerals was printed on paper having a basis weight of 6.4 grams per square meter with an ink-based zincated alkylphenol-formaldehyde novolac resin. The numerals were invisible to the human eye.

A mixture of 100 grams of chromogen-containing microcapsules dispersed in waxes (OPAS Activator from Mead Corporation) and 5 grams of gold powder (grade RG 9825 from United States Bronze Powders Inc.) was heated to about 90° C. and thoroughly mixed. The hot wax liquid was coated on a paper substrate which has a pressure-sensitive adhesive and release liner on its opposite side. The assembly was die-cut into the outline shape of a football and glued onto a document by applying a permanent adhesive on the back side of the release liner.

The capsule-coated football-shaped substrate was peeled off the release liner. It firmly adhered to the finger. A visible black colored image appeared instantly when the coated was rubbed over the hidden entries.

EXAMPLE 3

This experiment was performed according to the procedure of Example 6 described in U.S. Pat. No. 3,823,022 except that an alkylphenol-formaldehyde novolac resin (a Lewis acid) similar to that used in Example 1, above, was used instead of 2,4-dihydroxyacetophenone (a Lewis acid).

A solid marking crayon was proposed by mixing 13 grams of polyethylene glycol (Carbowax 4000 manufactured by Union Carbide) with one gram of alkylphenol-formaldehyde novolac resin HRJ-2346. The mixture was heated to about 100° C. until a clear solution was obtained. The molten material was molded to form a crayon. Rubbing this crayon over the latent images prepared in Example 1 of this invention failed to produce visible colored images. Apparently, alkylphenol-formaldehyde novolac resin was desensitized by the polyethylene glycol (Carbowax), since it is a known desensitizer, as disclosed in U.S. Pat. No. 4,199,618 to Golden.

EXAMPLE 4

This experiment was conducted to demonstrate that polar waxes preferred in the present invention are superior to the Lewis base wax, polyethylene glycol (Carbowax), used in U.S. Pat. No. 3,823,618 to Thomas.

Thirteen grams of a polar wax, HOECHST WAX KSL (a hard ester wax derived from montan wax by Hoechst Celanese Corporation), were mixed in one gram of alkylphenol-formaldehyde novolac resin HRJ-2346 (from Schenectady Chemicals, Inc.). The mixture was heated to about 100° C. until a clear solution was obtained. The hot liquid was molded to form a crayon. Rubbing this crayon over the hidden entries prepared in Example 1 instantly developed a visible colored image.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification.

What is claimed is:

1. A device for developing a latent image in a hidden entry system comprising a substrate having a first surface and a second surface, said first surface of said substrate bearing an image-developing co-reactant, said image-developing co-reactant being a chromogen or a color developer, said second surface of said substrate bearing a pressure-sensitive adhesive, said substrate being configured such that said substrate may be gripped by digitally engaging said pressure-sensitive adhesive to rub a latent image with said image-developing co-reactant, said latent image being formed from a reactant capable of forming a visible image upon contact with said image-developing co-reactant.

2. The device of claim 1, wherein said chromogenic composition additionally comprises a wax.

3. The device of claim 2, wherein said wax is a polar wax.

4. The device of claim 2, wherein said chromogenic composition additionally contains a metallic powder.

5. The device of claim 1, wherein said substrate is configured in the shape of a coin.

6. The device of claim 1, wherein said image-developing co-reactant is a color developer.

7. The device of claim 1, wherein said image-developing co-reactant is a chromogen.

8. The device of claim 7, wherein said chromogen is microencapsulated.

9. The device of claim 1, wherein said device has a thickness of from about 6 to about 12 mils.

10. A hidden entry system comprising a first substrate bearing a localized latent image and an image-developing device spaced apart from said localized latent image and comprising a second substrate having a first surface and a second surface, said first surface of said second substrate bearing a chromogenic composition, said chromogenic composition comprising a mixture of a polar wax and an image-developing co-reactant, said image-developing co-reactant being a chromogen or a color developer, said second surface of said second substrate bearing a pressure-sensitive adhesive, said image-developing device being in superposed relation with said first substrate and with said pressure-sensitive adhesive being releasably attached to said first substrate.

11. The hidden entry system of claim 10, wherein said latent image is formed from a chromogen and said image-developing co-reactant is a color developer.

12. The hidden entry system of claim 10, wherein said chromogenic composition additionally contains finely divided metallic particles.

13. The hidden entry system of claim 9, wherein said image-developing device has a thickness of between about 6 and about 12 mils.

14. The hidden entry system of claim 10, wherein said pressure-sensitive adhesive contacts a release liner permanently adhered to said first substrate.

15. The hidden entry system of claim 10, wherein said pressure-sensitive adhesive contacts a release coating directly adhered to said first substrate.

16. The hidden entry system of claim 11, wherein said pressure-sensitive adhesive directly contacts said first substrate.

17. A multi-ply form comprising a multiplicity of forms joined end-to-end, each said form comprising a first substrate having a first surface bearing a localized latent image comprising an image-forming reactant, which is either a chromogen or a color developer, and an image-developing device comprising a second substrate having a first surface and a second surface, said first surface of said second substrate bearing a chromogenic composition, said chromogenic composition comprising an image-developing co-reactant, said image-developing co-reactant being a chromogen or a color developer capable of reacting with said image-forming reactant to form a visible image, said second surface of said second substrate bearing a pressure-sensitive adhesive, said image-developing device being in superposed relation with said first surface of said first substrate and with said pressure-sensitive adhesive being releasably attached to said first surface of said first substrate.

18. The multi-ply form of claim 17, wherein the latent image on each said form comprises a numerical sequence differing or repeating from form to form.

19. A hidden entry system comprising a first substrate bearing a latent image and a localized release coating, said latent image and said release coating being spaced apart on said substrate, said release coating supporting an image developing device, said image developing device comprising a second substrate having a first surface and a second surface, said first surface of said second substrate bearing an image-developing co-reactant, said image-developing co-reactant being a chromogen or a color developer, said second surface of said second substrate bearing a pressure-sensitive adhesive, said second substrate being configured such that said second substrate may be gripped by digitally engaging said pressure-sensitive adhesive to rub said latent image with said image-developing co-reactant, said latent image being formed from a reactant capable of forming a visible image upon contact with said image-developing co-reactant.

20. The hidden entry system of claim 19, wherein said latent image is formed from a chromogen and said image-developing co-reactant is a color developer.

21. The hidden entry system of claim 20, wherein said chromogen is microencapsulated.

22. The hidden entry system of claim 19, wherein said image-developing device has a thickness of between about 6 and about 12 mils.

23. The hidden entry system of claim 10, wherein said first substrate bears the indicia of a sweepstake ticket, lottery ticket, promotional award or contest form.

24. The hidden entry system of claim 19, wherein said first substrate bears the indicia of a sweepstake ticket, lottery ticket, promotional award or contest form.

* * * * *